US005707725A

United States Patent [19]

Feldstein et al.

[11] Patent Number: 5,707,725

[45] Date of Patent: Jan. 13, 1998

[54] COMPOSITE PLATING HAVING A GRADIENT IN DENSITY OF CODEPOSITED PARTICLES

[75] Inventors: Nathan Feldstein, Princeton; Michael D. Feldstein, Belle Meade, both of N.J.

[73] Assignee: Surface Technology, Inc., Trenton, N.J.

[21] Appl. No.: 314,494

[22] Filed: Sep. 29, 1994

Related U.S. Application Data

[63] Continuation-in-part of Ser. No. 5,680, Jan. 19, 1993, abandoned.

[51] Int. Cl.[6] ..... B32B 17/00

[52] U.S. Cl. ..... 428/325; 428/328; 428/469; 428/472; 428/547; 428/610; 428/696; 428/698; 428/699; 428/701; 428/702

[58] Field of Search ..... 428/457, 469, 428/689, 610, 547, 696, 698, 699, 701, 702, 325, 328, 472

[56] References Cited

U.S. PATENT DOCUMENTS

| | | | |
|---|---|---|---|
| Re. 33,767 | 12/1991 | Christini | 428/544 |
| 3,562,000 | 2/1971 | Parker | 427/383.7 |
| 3,614,183 | 10/1971 | Berens | 384/486 |
| 3,617,363 | 11/1971 | Metzger | 427/383.7 |
| 3,723,078 | 3/1973 | Parker | 428/559 |
| 3,753,667 | 8/1973 | Metzger | 428/639 |
| 4,358,922 | 11/1982 | Feldstein | 57/401 |
| 4,358,923 | 11/1982 | Feldstein | 57/401 |
| 4,547,407 | 10/1985 | Spencer, Jr. | 427/367 |
| 4,666,786 | 5/1987 | Yano | 428/544 |
| 4,830,889 | 5/1989 | Henry | 427/438 |
| 4,851,190 | 7/1989 | Bowen | 428/610 |
| 4,911,625 | 3/1990 | Begg | 428/610 |
| 4,997,686 | 3/1991 | Feldstein | 427/443.1 |
| 5,103,637 | 4/1992 | Itoh | 428/610 |
| 5,145,517 | 9/1992 | Feldstein | 106/1.05 |
| 5,164,236 | 11/1992 | Schmid | 428/34.4 |
| 5,330,330 | 7/1994 | Kuwabara | 417/413.1 |

*Primary Examiner*—Timothy Speer
*Attorney, Agent, or Firm*—Lerner, David, Littenberg, Krumholz & Mentlik

[57] ABSTRACT

A process for the codeposition of a composite metallic coating comprising finely divided particulate matter dispersed within metallic matrixes and having a gradient in particle density distribution along the coating thickness. The established gradient ranges from a region of high density of particles to a region of lower density of particles along the coating thickness. The established gradient is affected by the deliberate change(s) in plating parameter(s) during the plating cycle.

12 Claims, No Drawings

COMPOSITE PLATING HAVING A GRADIENT IN DENSITY OF CODEPOSITED PARTICLES

REFERENCE TO PRIOR APPLICATIONS

This application is a continuation-in-part to application Ser. No. 08/005,680 filed Jan. 19, 1993 now abandoned.

BACKGROUND OF THE INVENTION

The plating of articles with composite coatings bearing finely divided particulate matter is well documented. This technology has been widely practiced in the field of electroplating and the field of electroless plating. The acceptance of these composite coatings stems from recognition that the inclusion of finely divided particulate matter within metallic matrixes can significantly alter the properties of the coating with respect to properties such as wear resistance, corrosion resistance, appearance, and lubricity.

Electroless composite technology is a more recent development as compared to electrolytic composite technology. The state of the art can be reviewed in a recent text entitled "Electroless Plating Fundamentals and Applications," edited by G. Mallory and J. B. Hadju, Chapter 11, published by The American Electroplaters Society, 1990.

The evolution of composite electroless plating dates back to Oderkerken U.S. Pat. No. 3,614,183 in which a structure of composite electroless nickel with finely divided aluminum oxide was interposed between metallic layers for improved corrosion resistance. Thereafter, Metzger et al in U.S. Pat. Nos. 3,617,363 and 3,753,667 extended the Oderkerken work to a greater variety of particles and miscellaneous electroless plating baths. In each of the above cases, the identical condition was maintained throughout each test to achieve a composite layer with the finely divided particles uniformly codeposited and dispersed within the metallic matrix. Christini et al, in Reissue Patent 33,767 further extended composite electroless plating to the codeposition of diamond particles. In addition, Christini et al demonstrated certain advantages associated with the deposition of a barrier layer (strike) prior to the composite layer.

Yano et al, in U.S. Pat. No. 4,666,786 disclosed the combination of silicon carbide with boron nitride which provides with enhanced properties.

Feldstein in U.S. Pat. Nos. 4,358,922 and 4,358,923, demonstrated the advantages of utilizing an overlay layer, above the composite layer. The overlay layer is essentially free of any particulate matter. The main advantage recognized in these two patents is the ease by which the smoothness of hard deposits can be attained in a short duration. Further appreciation for the nickel overlay is noted in U.S. Pat. No. 5,164,236.

Spencer, in U.S. Pat. No. 4,547,407, demonstrated the utility of mixtures of dual sizes of particles in achieving smoothness of coating.

Feldstein et al, in U.S. Pat. Nos. 4,997,686, 5,145,517, and 5,330,330 demonstrated the utilization of particulate matter stabilizer(s) in the deposition of uniform and stable composite electroless plating.

Henry et al in U.S. Pat. No. 4,830,889 disclosed a composition for the codeposition of graphite fluoride.

Parker, U.S. Pat. Nos. 3,562,000 and 3,723,078, demonstrated the codeposition of certain refractory metals and chromium along with composite electroless plating.

Although significant work has been reported in the above cited patent literature and publications which are included herein by reference, with different objectives and results, there is one common theme in all the above references. Specifically, they all demonstrate the practice of identical plating conditions throughout the codeposition plating cycle to achieve a composite with a uniform density of the particles dispersed within the metallic matrix. The prior art has not suggested or recognized any advantage(s) associated with composite coating(s) having a gradient of particle density within the coating thickness.

Despite the usefulness of the dual layer (U.S. Pat. Nos. 4,358,922 and 4,358,923), we have recognized certain practical limitations associated with it. It is necessary to use multiple plating tanks, compositions, and pre-plate solutions to produce the dual layer, and this not only adds to the manufacturing costs but also adds to the costs of waste treatment. In addition, the deposition of multiple layers may, at times, lead to poor adhesion between the layers and moreover it can not lead to a gradual (gradient) change in the percent of particles deposited if required.

Accordingly, it is highly desirable to achieve the properties of the dual layer combination or modifications thereof, but it would be preferable to achieve these properties in a single step and from the same plating tank. Such an improvement is of special value for articles used in textiles, molds, engines, and other applications in which the ease of smoothing or break-in time is required.

SUMMARY OF THE INVENTION

Generally stated, the present invention accomplishes several of the above objectives by providing a novel process for the deposition of composite plated articles bearing finely divided particulate matter dispersed within metallic matrixes. The finely divided particulate matters may have any of several characteristics such as, wear resistance, corrosion resistance, and lubricity as well as combinations thereof.

The present invention provides a composite layer structure wherein the finely divided particulate matter is deposited in a non-uniform manner which however is in a preselected pattern having a gradient in particle size density along the deposit thickness. More specifically, the deposited gradient density decreases within the metallic layer. The article resulting from the present process provides at least the same features as the prior art, however it all is incorporated into a single layer and does not require multiple steps or layers as taught in U.S. Pat. No. 4,358,922 and others. An additional benefit associated with the present method is the simplicity in the metallization steps, the longer lifetime associated with the composite plated articles, and the elimination of multiple plating baths. The latter thereby minimize the waste treatment aspect required by user. Further advantages of the present article will become apparent to those skilled in the art upon consideration of the following detailed description.

In addition, though the main points of the invention are associated with composite electroless plating, one skilled in the art will recognize that the present invention can be adopted for a composite derived from electrolytic plating as well. Accordingly, in the broad sense, this invention is applicable to composite plated articles derived from electrolytic plating as well. From the prior art it should be recognized that a variety of combinations of matrices and particulate matter can be codeposited. The inclusion of such combinations can be adapted to the present invention and hence their adaption to the present invention will fall within the spirit of this invention.

DETAILED DESCRIPTION OF THE INVENTION

Plated composites bearing metallic matrixes with finely dispersed particulate matter are well known in the art. Many studies have focuses on the mechanism of codeposition, particularly in electrodeposition. However, the mechanism for codeposition in electroless composite is still not fully understood despite the work reported in many publications and issued patents.

There are several known parameters that can affect the density of the codeposited insoluble particulate matter. Though we do not wish to be bound by theory, in electroless composites, it has been recognized that certain plating bath parameters, such as the plating rate, the degree of agitation, and the concentration of chemicals can affect the density of the codeposition for a specific insoluble particulate matter and specific plating bath. The plating rate is generally affected by temperature, pH and concentration of chemicals (reactants).

In all of the prior art, it was generally the objective to yield a uniform (even) density of particles throughout the composite layer leading to a "regenerative" type coating.

In the present invention there is a departure from previous practices. Specifically, the overall composite layer is plated in a manner that will lead to a gradation with respect to the density of particles deposited through the metallic coating. It is preferable that the main portion of the coating be comprised of a composite with a substantially uniform particle density, which then decreases towards a lower density near the surface. The density for the insoluble particulate matter nearest the surface (or the area adjacent to the interface) will thus be less than that of the main portion of the coating. Thus, the matting part in contact with the coated machinery part will equilibrate or break-in in a short period of time. This feature is particularly useful with codeposits having a wear resistance particulate matter. This feature can be achieved with great ease by controlling the rotational rate (speed) of the part during the plating cycle while immersed in the plating bath.

The following example demonstrates the process associated with the present invention. In this example the rotation was modified as a plating bath parameter.

EXAMPLE 1

Steel rods 5½" in length and ⅜" in diameter were used. The plating composition was a CDC electroless nickel plating bath manufactured and sold by Surface Technology, Inc., Trenton, N.J. This bath comprised a nickel salt and sodium hypophosphite as the reducer. Diamond dust having a mean particle size of approximately 1.7 micron was used with a loading of approximately 3.5 g/l of plating bath. The bath was operated at 188° F. with a pH of 4.6. The rods were submerged within the plating composition and plated according to the following schedule:

1¼ hours with a rotation of 9.3 rpm.

1¼ hours with a rotation of 168 rpm.

After plating, photomicrographs of a cross sectional cut at 400× and 1,000× magnification were taken of the plated rods with the following observations:

Corresponding to the first rotational speed, a dense layer with diamond was deposited with an overall thickness of about 19 microns. Thereafter a layer without any particles and a thickness of about 15 microns was observed.

In this experiment the gradient reflects an extreme case, it is obvious that other gradients may be derived based and controlled by the rotational speeds imposed (changes) during the plating cycle.

Further experimentation at varied rotational speeds revealed intermediate diamond densities. There appears to be a linear relationship between the diamond density codeposited vs. the rotational speed when plotting a function related to diamond density vs. the rotational speed. Similar observations were noted with silicon carbide, aluminum oxide, and boron nitride particulate matter, though having different sensitivities, all however, having a negative slope.

Also, in this example modification(s) of rotation speed was illustrated and it is recognized that other plating bath parameters may be used in practicing the present invention.

From the above, it should be obvious that the present invention is not limited to the nature of the particles used nor the plating bath or substrate used.

In the current process, by adjusting the selected parameter (s), the use for the plating bath can be made for repeated uses. From the above example, readjusting the rotational speed to 9.3 rpm results in a coating substantially the same as the starting point, provided that the chemical ingredients are at the set concentration and other parameters are held constant.

I claim:

1. An electrolessly metallized article comprising a substrate, a plated composite film having an exposed outer surface deposited onto said substrate, said plated film comprises a metallic matrix with finely divided particulate matter dispersed therein, said plated film comprising a gradient in the particle density for said dispersed particulate matter across the plated thickness commencing from a high density region adjacent said substrate to a low density region adjacent said outer surface of said plated film, and wherein said gradient in the particle density is generated by the immersion of said article in a single plating composition.

2. The article according to claim 1 wherein said particulate matter is a wear resistant particle.

3. The article according to claim 1 wherein said particulate matter is a lubricating particle.

4. The article according to claim 1 wherein said metallic matrix is a nickel alloy.

5. An electrolessly metallized substrate produced by the method comprising contacting said substrate with a plating composition comprising metal ions and finely divided insoluble particles dispersed therein; rotating said substrate in contact with said plating composition at a first rotational rate while depositing a composite first layer of metal on said substrate containing said insoluble particles dispersed therein at a first density; rotating said substrate having said first layer thereon in contact with said plating composition at a second rotational rate different from said first rotational rate while depositing a second layer of metal on said first layer, said second layer having an insoluble particle density which is lower in quantity than said first density of said insoluble particles in said first layer; and selecting the first and second rates of rotation of said substrate such that the first and second layers have a predetermined density of insoluble particles therein.

6. The substrate according to claim 5 wherein said insoluble particles comprise wear resistant particles.

7. The substrate according to claim 5 wherein said insoluble particles comprise lubricating particles.

8. The substrate according to claim 5 wherein said metal ions comprise nickel ions.

9. An electrolessly metallized substrate produced by a method comprising contacting said substrate with a plating composition comprising metal ions and finely divided insoluble particles dispersed therein; exposing said substrate in contact with said plating composition at a first setting of a plating parameter while depositing a composite layer of metal on said substrate containing said insoluble particles dispersed therein at a first density; continuing said deposition of said composite layer of said metal at a secondary setting of a plating parameter wherein said insoluble particles dispersed therein are at a secondary density said secondary density of insoluble particles being lower in quantity than said first density of insoluble particles, whereby the density of said insoluble particles is highest adjacent said substrate and lowest adjacent the outer surface of said composite layer.

10. The substrate according to claim 9 wherein said insoluble particles comprise wear resistant particles.

11. The substrate according to claim 9 wherein said insoluble particles comprise lubricating particles.

12. The substrate according to claim 9 wherein said metal ions comprise nickel ions.

* * * * *